US007237527B2

(12) United States Patent
Pontoppidan

(10) Patent No.: US 7,237,527 B2
(45) Date of Patent: Jul. 3, 2007

(54) FUEL INJECTOR FOR AN INTERNAL COMBUSTION ENGINE

(75) Inventor: Michaël Pontoppidan, Colombes (FR)

(73) Assignee: Magneti Marelli Motopropulsion France SAS, Nanterre (FR)

( * ) Notice: Subject to any disclaimer, the term of this patent is extended or adjusted under 35 U.S.C. 154(b) by 0 days.

(21) Appl. No.: 10/547,367

(22) PCT Filed: Feb. 27, 2004

(86) PCT No.: PCT/FR2004/000459

§ 371 (c)(1),
(2), (4) Date: Aug. 29, 2005

(87) PCT Pub. No.: WO2004/079178

PCT Pub. Date: Sep. 16, 2004

(65) Prior Publication Data

US 2006/0231065 A1 Oct. 19, 2006

(30) Foreign Application Priority Data

Feb. 28, 2003 (FR) ..... 03 02466

(51) Int. Cl.
*F02B 5/02* (2006.01)
*F02B 15/00* (2006.01)

(52) U.S. Cl. ..... 123/298; 123/305

(58) Field of Classification Search ..... 123/298, 123/305

See application file for complete search history.

(56) References Cited

U.S. PATENT DOCUMENTS

| | | | | |
|---|---|---|---|---|
| 5,540,200 | A | 7/1996 | Naitoh et al. | |
| 6,513,487 | B1 | 2/2003 | Jorach et al. | |
| 2002/0000483 | A1 | 1/2002 | Shoji et al. | |
| 2002/0083920 | A1 | 7/2002 | Konig et al. | |
| 2005/0224605 | A1 * | 10/2005 | Dingle | 239/533.2 |
| 2005/0224606 | A1 * | 10/2005 | Dingle | 239/533.2 |

FOREIGN PATENT DOCUMENTS

| | | |
|---|---|---|
| DE | 196 412 513 | 4/1998 |
| FR | 2 399 551 | 3/1979 |

* cited by examiner

*Primary Examiner*—Erick Solis
(74) *Attorney, Agent, or Firm*—Stites & Harbison PLLC; Douglas E. Jackson

(57) ABSTRACT

A fuel injector comprising a head which has a free outer face and a main orifice designed to spray a fuel jet in a main direction and a secondary orifice designed to spray a fuel jet in a secondary direction, the main and secondary orifices opening into the outer face and communicating directly with a common injection chamber which is selectively placed in communication with a supply chamber. The secondary direction forms an angle α between 10° and 80°, with the main direction so that the secondary jet intercepts the main jet in a burst zone which starts at a distance d of between 1 and 15 mm, and the flow rate of the secondary jet is between 80% and 100% of the flow rate of the main jet. The invention also relates to a spark ignition engine and to a method of manufacturing the injector.

18 Claims, 2 Drawing Sheets

FIG.2.
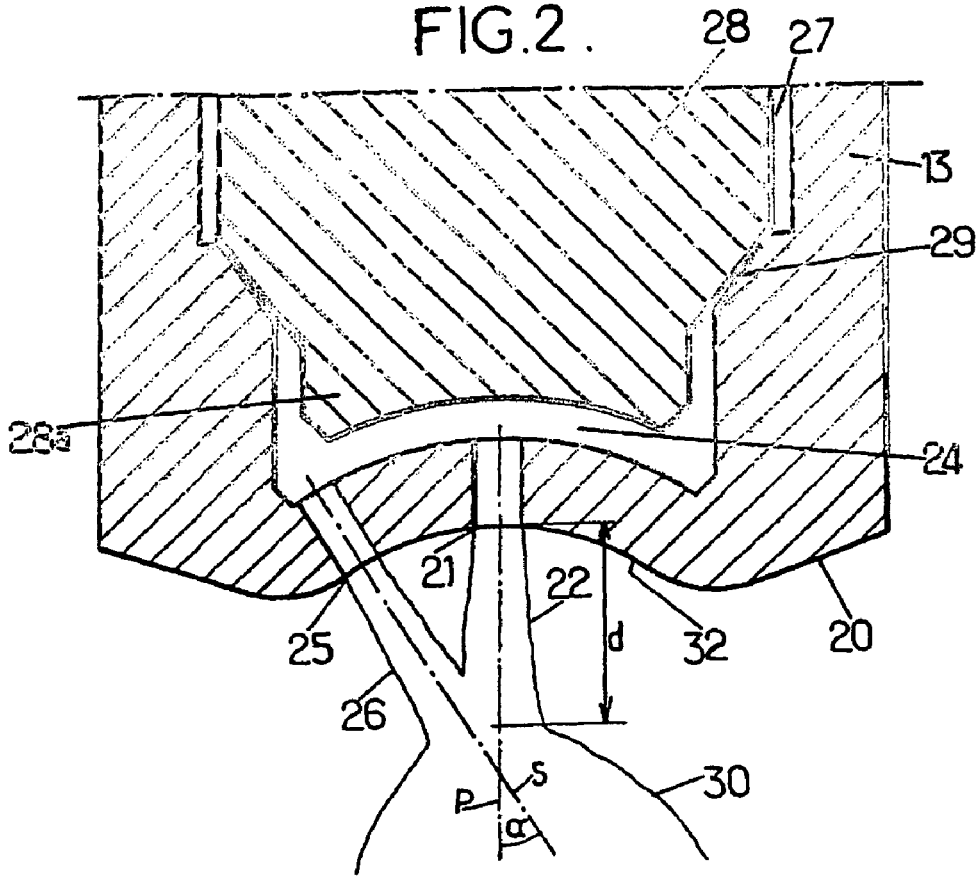
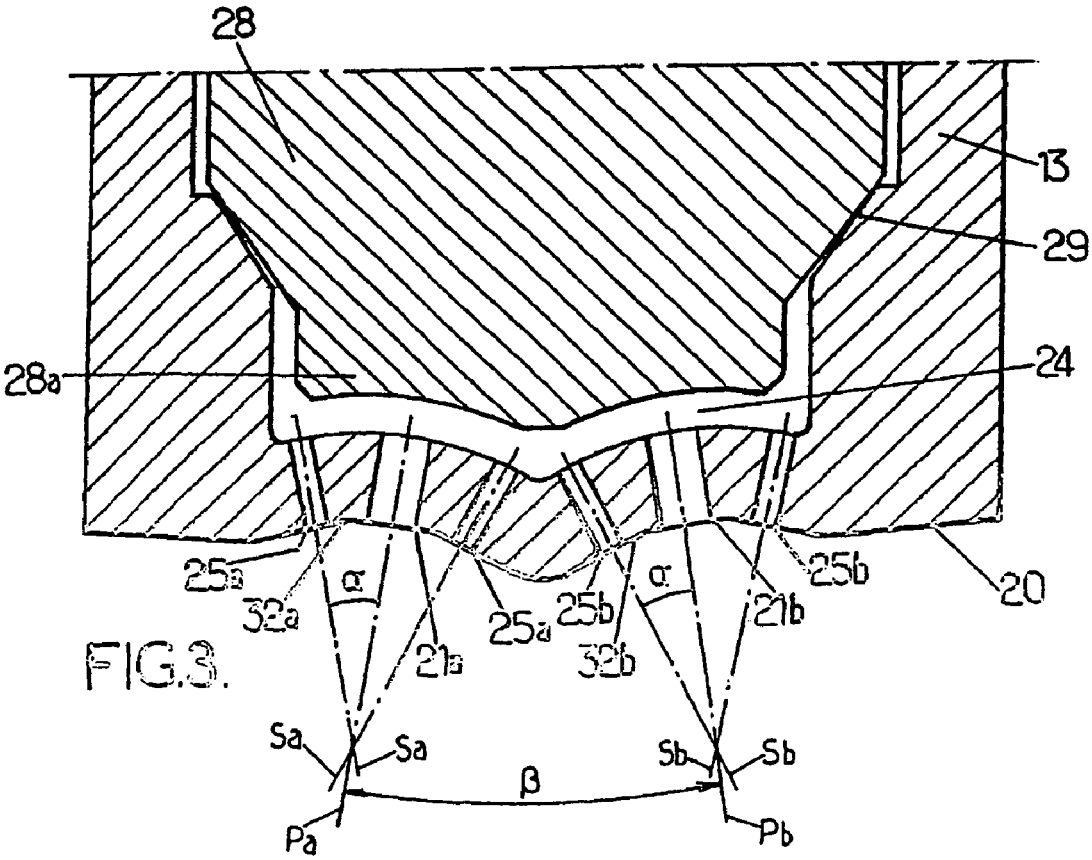
FIG.3.

FUEL INJECTOR FOR AN INTERNAL COMBUSTION ENGINE

FIELD OF THE INVENTION

The present invention relates to a fuel injector for spraying fuel into the combustion chamber of an engine. More specifically, it relates to an injector comprising a head which has a free outer face and which is provided with at least one main orifice designed to spray a fuel jet in a main direction and at least one secondary orifice designed to spray a fuel jet in a secondary direction, said main and secondary orifices opening into the outer face and communicating directly with a common injection chamber which is selectively placed in communication with a supply chamber.

BACKGROUND OF THE INVENTION

In the case of spark ignition engines with direct injection of the fuel into the combustion chamber, it is necessary to rapidly obtain well controlled spraying of the fuel jet. Specifically, the spraying must exhibit a certain directionality and a penetration rate sufficient to obtain a fuel-air ratio around the spark plug at the moment of ignition that enables the mixture to be ignited. However, the depth of the sprayed jet which increases with the injection pressure, must not be excessive so as, in particular, not to spray fuel against the walls of the combustion chamber.

To this end, use has been made of swirl injectors in which the fuel is guided with a swirling motion in the injector before being sprayed. These injectors make it possible to obtain good atomization but, in addition to their high cost, they have the disadvantage of creating a high internal pressure drop in the supply pressure and consequently make it essential to apply a high force in order to actuate the control needle of these injectors. In practice, it is difficult to use these injectors with a fuel supply pressure above 150 bar. Moreover, these injectors create a poorly directional jet with a relatively low rate of penetration into the chamber, which makes it more difficult in some cases to obtain a stratified mixture, that is to say a gas mixture whose fuel-air ratio is greater in certain defined parts of the combustion chamber.

In the case of these engines, it is also known practice to use multihole injectors comprising a plurality of orifices which spray fuel jets in divergent directions. These injectors make it possible to obtain a higher penetration rate and very good directionality of all the fuel jets. Moreover, they create fewer internal pressure drops and are less difficult to manufacture than injectors provided with a swirl atomizer. On the other hand, the fuel is sprayed with less efficiency since the contact area with the gases is smaller and the fuel jet is less turbulent than with the swirl injectors. Consequently, the degree of mixing of the fuel with the combustion chamber gases is less able to be controlled in certain situations, which has harmful consequences in terms of the engine efficiency and the emission of pollutants.

An object of the present invention is to overcome these disadvantages by providing an injector which allows high pressure direct injection into the combustion chamber with high efficiency spraying and a certain directionality, without however consequently increasing the depth of penetration of the atomized fuel jet and the cost of the injector.

SUMMARY OF THE INVENTION

To this end, the subject of the invention is a fuel injector of the aforementioned type, characterized in that said secondary direction forms an angle $\alpha$ between 10° and 80°, preferably between 15° and 45°, and more preferably equal to approximately 25°, with said main direction so that the secondary jet intercepts the main jet in a burst zone which starts at a distance d, measured in the main direction from the outer face of the head, of between 1 and 15 mm, preferably between 1 and 5 mm, and in that the flow rate of the secondary jet is between 80% and 100% of the flow rate of the main jet.

By virtue of this arrangement, starting from the burst zone which begins a small distance away from the injector, the main jet is driven with a significant radial speed component with respect to the main direction. Better atomization of the main jet and of the secondary jet is thus obtained starting from this burst zone, without however completely losing the directional power and the penetration rate of the main jet. Moreover, this injector, the orifices of which may be formed by simple cylindrical holes passing through a metal component, such as a metal sheet, does not result in a high excess manufacturing cost.

In preferred embodiments of the invention, use is additionally made of one and/or other of the arrangements below:

- the outer face of the head comprises at least one portion having an outwardly oriented concavity into which opens a main orifice and at least one secondary orifice;
- the main orifice and the secondary orifice open out perpendicularly to the outer face of the head;
- the head is provided with at least two secondary orifices which are uniformly distributed around the main orifice;
- the secondary orifices have secondary spray directions designed so that the secondary jets intercept the main jet at the same longitudinal position of the main direction;
- the head is provided with at least two main orifices designed to spray fuel jets in divergent main directions which between them form an angle $\beta$ of between 5° and 45°;
- each main jet is intercepted by at least two secondary jets sprayed through secondary orifices situated around the main orifice;
- the main orifice and the secondary orifice are cylindrical holes, the diameter of the secondary orifice being less than the diameter of the main orifice;
- the concave portion has a continuous curvature;
- the concave portion is formed by at least two facets, a primary facet into which a main orifice opens and a secondary facet into which a secondary orifice opens.

Moreover, the invention relates also to the use of an injector as defined above, with a spark ignition engine, in which the injector is arranged so as to spray the fuel directly into the combustion chamber.

For such a use, recourse may be had to one or other of the arrangements below:

- the injector is supplied with fuel at a pressure having a peak value of between 150 and 500 bar;
- the spray direction of the main orifice is arranged, as a function of the geometry of the combustion chamber and of the flow of gases in said chamber, so as to obtain a fuel-air ratio of between 0.7 and 1.2 in the vicinity of the spark ignition means at the moment of ignition.

The invention also relates to a method of manufacturing an injector as defined above, in which:

- the concave portion of the outer face is produced by deformation of an initially flat wall portion; and/or the main orifice and the secondary orifice opening out perpendicularly are cut by electrical discharge machining.

BRIEF DESCRIPTION OF THE DRAWINGS

Other features and advantages of the invention will become apparent in the course of the description which will follow, which is given by way of a non limiting example and with reference to the appended drawings, in which:

FIG. 2 is a partial longitudinal sectional view of a first embodiment of the injector represented in FIG. 1;

FIG. 3 is a view similar to that in FIG. 2 in which a second embodiment of the injector is represented.

The same references have been retained in the various figures to denote identical or similar elements.

DETAILED DESCRIPTION

Figure 1:
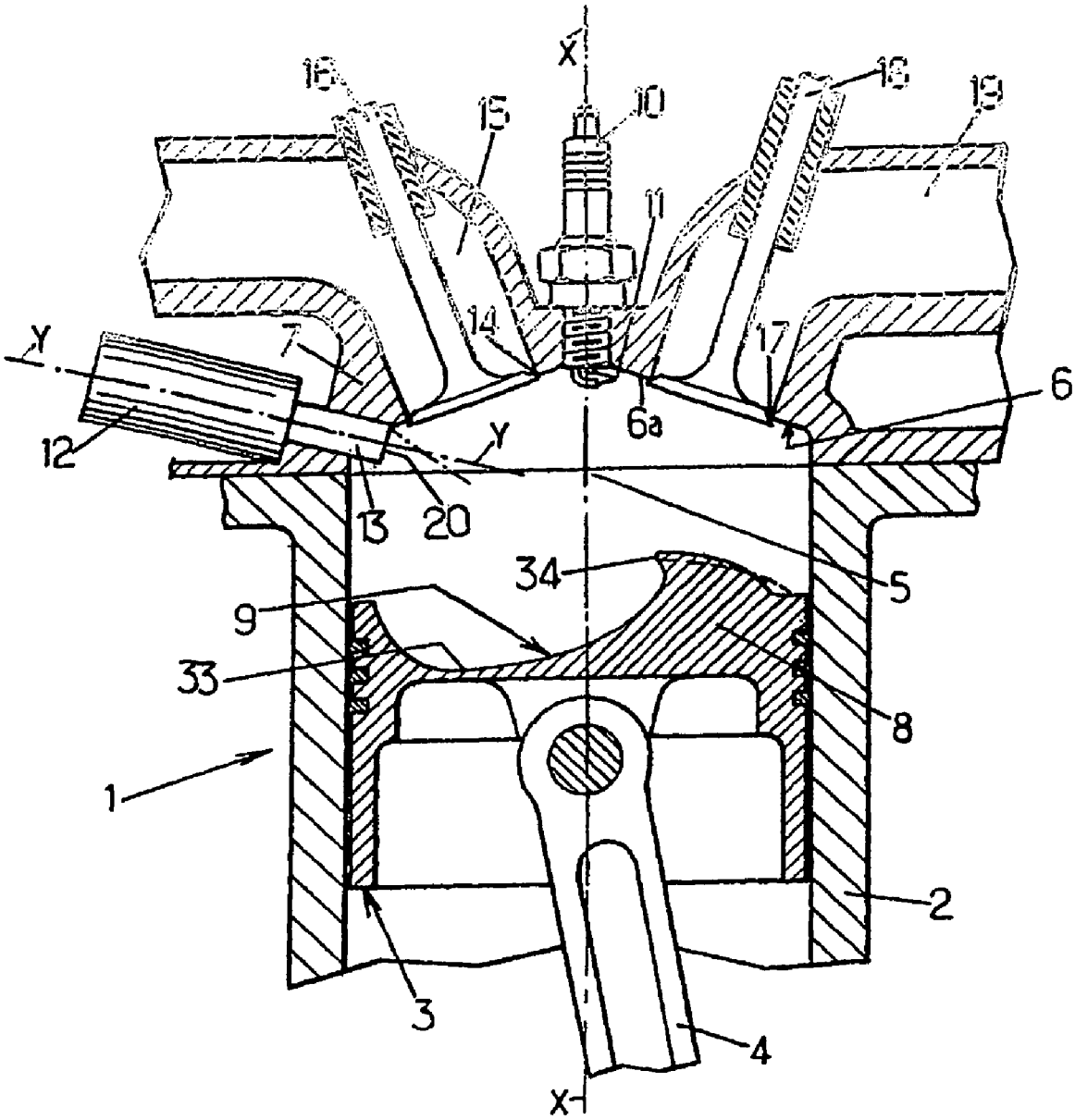
FIG. 1 is a simplified sectional view of a direct injection spark ignition engine comprising an injector according to the invention.

FIG. 1 schematically represents a cross section through a four stroke internal combustion engine 1 having a spark ignition and a direct fuel injection.

As is well known, the engine 1 has one, or more, cylinder 2 extending along a longitudinal axis X-X and in which a piston 3 is slidably mounted along the longitudinal axis. The piston 3 is connected to a crankshaft (not shown) by a connecting rod 4.

A combustion chamber 5 is defined by the upper end of the cylinder 2, a cavity 6 formed opposite the piston 3 in a cylinder head 7 attached to the cylinder 2, and by an end face 9 of the crown 8 of the piston 3. The cavity 6 in the cylinder head 7 is a roof shaped cavity, in other words it has two inclined planes meeting at a vertex 6*a* which intersects the longitudinal axis X-X of the cylinder 2.

When the engine in question is a spark ignition engine, the cylinder head 7 includes a spark plug 10 provided with electrodes 11 arranged in the region of the vertex 6*a* of the cylinder head. Although particularly intended for this type of engine, it is conceivable for the present invention to be applied to a diesel type compression ignition engine.

The cavity 6 in the cylinder head 7 comprises an intake opening 14 at the downstream end of an intake port 15 and an exhaust opening 17 at the upstream end of an exhaust port 19. The intake 14 and exhaust 17 openings are respectively closed by an intake valve 16 and an exhaust valve 18 which are opened and closed by any known means, such as a camshaft, for example. Of course, the shape of the combustion chamber 5 and the number of valves (16, 18) may be different without departing from the scope of the present invention.

The cylinder head 7 also comprises an injector 12 provided with an injection head 13, which extends along an axis Y-Y. The head 13 of the injector has an outer face 20 arranged in the combustion chamber 5.

The injector 12 is connected to a fuel supply duct (not shown). The supply duct contains fuel under high pressure, that is to say a pressure which at least instantaneously reaches a value above 100 bar and which corresponds substantially to the pressure at which the fuel is injected into the combustion chamber. In the case of a duct supplying a number of injectors under high pressure, the latter is generally referred to as a common rail. It will be noted, however, that the head of the injector produced according to the invention may be used in an injector/pump type injection system in which the injector is combined with a high-pressure pump.

As appears more clearly in FIG. 2, the outer face 20 of the head 13 of the injector is provided with a main orifice 21 designed to spray a fuel jet, represented schematically by the contour 22, coming from an injection chamber 24. The jet 22 from the main orifice 21 is oriented in a direction P, called the main direction, determined by the shape of the orifice 21 and corresponding to the axis of symmetry of the base of the jet 22.

The outer face 20 is also provided with a secondary orifice 25 designed to spray a fuel jet 26 in a direction S, called the secondary direction. The outer face 20, and more precisely the portion thereof into which the orifices open, is free of any obstacle which could mask one and/or other of the orifices. The secondary orifice 25 also communicates directly with the injection chamber 24, which is thus common to the main and secondary orifices, so that the spraying through the two types of orifice is simultaneous.

In order to control the injection of fuel, the injection chamber 24 is selectively placed in communication with a supply chamber 27 containing fuel under pressure. Communication between the injection chamber 24 and the supply chamber 27 is obtained by lifting a needle 28 from a seat 29 formed in the head 13 of the injector. The needle 28 can be lifted by mechanical, electromagnetic or piezoelectric means synchronized with the rotation of the crankshaft.

It will be noted that the end 28*a* of the needle has a geometry which complements the inner face of the head 13 so as to minimize the volume of the injection chamber 24 in order to prevent fuel flowing into the combustion chamber 5 at an unwanted moment.

The secondary direction S of the secondary jet 26 is oriented towards the main direction P of the main jet 22 so that the secondary jet 26 intercepts the main jet 22 in a zone called the burst zone represented schematically by the contour 30, and the flow rate of the secondary jet 26 is at most equal to the flow rate of the main jet 22.

By virtue of this arrangement, a total or partial collision between the secondary jet 26 and the main jet 22 is obtained, which makes it possible, starting from the burst zone 30, to create a speed component in the main jet 22 which is radial with respect to the main direction P of this jet. This allows better atomization of the fuel injected into the combustion chamber 5 and consequently makes it possible to increase the degree of mixing of the fuel with the gases contained in the combustion chamber.

It will be noted that, in order to obtain a high degree of bursting of the main jet 22, tests show that the flow rate of the secondary jet must be at least equal to 80% of the flow rate of the main jet in order that the quantity of movement of the secondary jet reduces the penetration of the main jet by 30% to 40%.

In the embodiment represented in FIG. 2, the main direction P and the secondary direction S between them form an angle of about 25°. However, it is possible to vary this angle as a function of the ratio between the flow rates of the main jet and of the secondary jet and as a function of the degree of bursting of the main jet that one wishes to obtain. The angle $\alpha$ may be between 10° and 80°, but it is preferable for the angle $\alpha$ to remain between 15° and 45°.

The burst zone 30 starts at a distance d measured in the main direction P from the outer face 20 of the injector head 13. This distance d is between 1 and 15 mm to obtain a good compromise between the directionality and bursting of the main jet 22, but is preferably less than 5 mm to obtain early bursting and a relatively limited depth of penetration.

Since the flow rate of the jet 22 sprayed through the main orifice 21 is greater than or equal to the flow rate of the secondary jet 26, the directionality and the penetration rate necessary for the fuel injected into the combustion chamber are obtained, particularly by adjusting the distance between the orifices and the angle α. Furthermore, the atomized fuel jet forms a solid cone and not a hollow cone such as that obtained with a swirl injector.

It is not absolutely necessary for the secondary direction S to intersect the main direction P exactly. Effectively, given the diameters and the flow rates of the main fuel jet and the secondary jet, it is possible to obtain sufficient interception of the fuel jets with a secondary direction S slightly offset with respect to the main direction P, which limits the depth of penetration.

As can be seen in FIG. 2, the main orifice 21 and the secondary orifice 25 are cylindrical holes opening out perpendicularly to the outer face 20 of the head. These cylindrical holes opening out perpendicularly to the outer face 20 are advantageously produced by electrical discharge machining. However, it is possible to produce them by other known techniques, such as punching.

However, the orifices (21, 25) could have a different shape, particularly in the case of an injector intended for a diesel engine. Specifically, for this type of engine, the fuel injection pressure is significantly higher, above 1,000 bar, and the wall of the injector head 13 is thicker, which makes it possible for the orifices to be produced with a frustoconical shape.

It will be noted that the orifices (21, 25) open directly into the injection chamber 24, thereby limiting the pressure drops in the injector head, unlike swirl injectors which require a device upstream of the orifice to impart a circular motion to the fuel.

The outer face 20 of the head 13 comprises a portion 32 having an outwardly oriented concavity into which the main orifice 21 and the secondary orifice 25 open perpendicularly such that the secondary direction S is oriented towards the main direction P.

The concave portion 32 has a continuous curvature which may be obtained by stamping an initially flat portion of sheet metal.

As can be seen in FIG. 3, which represents a second embodiment of a fuel injector according to the invention, it is possible to multiply the number of main orifices and the number of secondary orifices.

The head 13 of the injector 12 comprises, in this second embodiment, two main orifices (21*a*, 21*b*) which respectively spray fuel jets (not shown) in a main direction Pa and a main direction Pb.

In order to obtain spraying across a wider angle in the combustion chamber, the main directions Pa and Pb are divergent and between them form an angle β of about 15°. Depending on the fuel-spraying characteristics which are imposed by the geometry of the combustion chamber and the flow of the gases, it may be advantageous to vary the angle β between the main directions Pa and Pb from 5 to 45°.

The outer face 20 of this second embodiment comprises two main orifices (21*a*, 21*b*) which are respectively assigned two secondary orifices (25*a*; 25*b*).

The secondary orifices 25*a* are situated diametrically opposite one another with respect to the main orifice 21*a*, which makes it possible to retain a certain degree of symmetry of the main fuel jet starting from the burst zone. It will be noted that it is possible to retain this symmetry by arranging around the main orifice 21*a* more than two secondary orifices distributed in a uniform angular manner.

The secondary directions Sa of the jets sprayed through the secondary orifices 25*a* are arranged so that the secondary jets intercept the main jet of the orifice 21*a* at the same longitudinal position of the main direction Pa.

The two main orifices (21*a*, 21*b*) and the four secondary orifices (25*a*, 25*b*) are contained in the same plane, but it is conceivable for the two main orifices 21*a*, 21*b* to be arranged in a first longitudinal plane of the injector head 13 and for the secondary orifices (25*a*, 25*b*) to be arranged in two planes which are perpendicular to the first longitudinal plane.

The outer face 20 comprises a first concave portion 32*a* into which the orifices 21*a* and 25*a* open and a second concave portion 32*b* into which the orifices 21*b* and 25*b* open. Each concave portion (32*a*; 32*b*) comprises three facets, a central facet into which the main orifice opens perpendicularly and two lateral facets into which the secondary orifices open perpendicularly.

The wall of the injector comprising the facets is relatively thin when the pressure in the supply chamber 27 does not exceed 500 bar. For the purpose of limiting the manufacturing cost, this portion of the outer face comprising the concavities (32*a*; 32*b*) is thus formed by stamping, that is to say by deforming an initially flat portion rather than machining or molding it.

As represented in FIG. 1, the injector produced according to the invention is arranged in a spark ignition engine so that gasoline can be sprayed directly into the combustion chamber. The injector according to the invention makes it possible to adjust very precisely the characteristics of the sprayed jet, and particularly the direction, the rate and depth of penetration, and also the atomization of the fuel, this being particularly advantageous for this type of engine. Specifically, a spark ignition engine requires very precise spraying, in particular in order to have a sufficient fuel-air ratio in the region of the ignition means at the moment when ignition is initiated.

The main direction P of the main orifice, or of the main orifices, is arranged with consideration to the geometry of the combustion chamber, such as, for example, the presence of a hollow 33 and of a rim 34 formed on the end face 9 of the piston, and to the flow of the gases within the combustion chamber so as to obtain a fuel-air ratio between 0.7 and 1.2 in the vicinity of the electrodes 11 of the spark plug 10 at the moment when a spark is created between the electrodes.

It will be noted that, in order to obtain a correctly arranged spraying direction for the main orifice, it is possible for the main direction P to form a greater or lesser angle with the longitudinal axis Y-Y of the injector 12 or, in the case of a number of main orifices, for the main directions (Pa, Pb) not to be arranged symmetrically with respect to the longitudinal axis Y-Y of the injector.

The head 13 of the injector produced according to the invention creates little internal pressure drop and consequently the injector 12 may be supplied by a common rail containing fuel under high pressure. In the case of an injector for a spark ignition engine, the pressure at which gasoline is supplied to the injector 12 preferably reaches a peak value of between 150 bar and 500 bar.

The invention claimed is:

1. A fuel injector for spraying fuel into a combustion chamber of a spark ignition engine, comprising a head which has a free outer face and which is provided with at least one main orifice designed to spray a fuel jet in a main direction and at least one secondary orifice designed to spray a fuel jet in a secondary direction, said main and secondary orifices opening into said outer face, and a common injection chamber internal of said head and communicating directly with said main and secondary orifices, said injection chamber being selectively placed in communication with a supply chamber, wherein said secondary direction forms an angle α between 10° and 80°, with said main direction so that said secondary jet intercepts said main jet in a burst zone which starts at a distance d, measured in said main direction from said outer face of said head, of between 1 and 15 mm, and wherein said flow rate of said secondary jet is between 80% and 100% of said flow rate of said main jet.

2. The injector according to claim 1, wherein said outer face of said head comprises at least one portion having an outwardly oriented concavity into which opens a main orifice and at least one secondary orifice.

3. The injector according to claim 2, wherein said main orifice and said secondary orifice open out perpendicularly to said outer face of said head.

4. The injector according to claim 1, wherein said head is provided with at least two secondary orifices which are uniformly distributed around said main orifice.

5. The injector according to claim 4, wherein said secondary orifices have secondary spray directions designed so that said secondary jets intercept said main jet at said same longitudinal position of said main direction.

6. The injector according to claim 1, wherein said head is provided with at least two main orifices designed to spray fuel jets in divergent main directions which between them form an angle β of between 5° and 45°.

7. The injector according to claim 6, wherein each main jet is intercepted by at least two secondary jets sprayed through secondary orifices situated around said main orifice.

8. The injector according to claim 1, wherein said main orifice and said secondary orifice are cylindrical holes, the diameter of said secondary orifice being less than the diameter of said main orifice.

9. The fuel injector according to claim 2, wherein said concave portion has a continuous curvature.

10. The injector according to claim 2, wherein said concave portion is formed by at least two facets, a primary facet into which a main orifice opens and a secondary facet into which a secondary orifice opens.

11. Use of an injector according to claim 1, with a controlled-ignition engine, wherein said injector is arranged so as to spray the fuel directly into said combustion chamber.

12. The use of an injector according to claim 11, wherein said injector is supplied with fuel at a pressure having a peak value of between 150 and 500 bar.

13. The use of an injector according to claim 11, wherein the spray direction of said main orifice is arranged, as a function of the geometry of said combustion chamber and of the flow of gases in said chamber, so as to obtain a fuel-air ratio of between 0.7 and 1.2 in the vicinity of said ignition control means at the moment of ignition.

14. The injector according to claim 1, wherein said angle α is comprised between 15° and 45°.

15. The injector according to claim 1, wherein said angle α is equal to approximately 25°.

16. The injector according to claim 1, wherein said distance d is comprised between 1 and 5 mm.

17. A method of manufacturing a fuel injector for spraying fuel into a combustion chamber of a spark ignition engine, comprising a head which has a free outer face and which is provided with at least one main orifice designed to spray a fuel jet in a main direction, and at least one secondary orifice designed to spray a fuel jet in a secondary direction, said main and secondary orifices opening into the outer face and communicating directly with a common injection chamber internal of said head, which said injection chamber is selectively placed in communication with a supply chamber, wherein a concave portion of said outer face of the head is produced by deformation of an initially flat wall portion, wherein the main orifice and the secondary orifice are cut through the head such that said secondary direction forms an angle α between 10° and 80° with said main direction so that the secondary jet intercepts the main jet in a burst zone, which starts at a distance d, measured in the main direction from the outer face of the head, of between 1 and 15 mm, and wherein the flow rate of the secondary jet is between 80% and 100% of the flow rate of the main jet.

18. A method of manufacturing an injector according to claim 17, wherein said main orifice and said secondary orifice are cut by electrical discharge machining so that said orifices open out perpendicularly to the outer surface.

* * * * *